US009107562B2

(12) United States Patent
Haltmayer et al.

(10) Patent No.: US 9,107,562 B2
(45) Date of Patent: Aug. 18, 2015

(54) DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1346 days.

(21) Appl. No.: 12/381,883

(22) Filed: Mar. 17, 2009

(65) Prior Publication Data

US 2009/0266385 A1 Oct. 29, 2009

(30) Foreign Application Priority Data

Apr. 25, 2008 (DE) ..... 10 2008 020 922

(51) Int. Cl.
*B08B 3/00* (2006.01)
*A47L 15/48* (2006.01)
*A47L 15/42* (2006.01)

(52) U.S. Cl.
CPC ..... *A47L 15/483* (2013.01); *A47L 15/4246* (2013.01)

(58) Field of Classification Search
CPC ..... A47L 15/483; A47L 15/488
USPC ..... 134/56 D, 57 D, 58 D, 104.4, 104.2
See application file for complete search history.

(56) References Cited

U.S. PATENT DOCUMENTS

| | | | | |
|---|---|---|---|---|
| 4,179,821 | A * | 12/1979 | Herbst et al. | 34/235 |
| 5,056,543 | A * | 10/1991 | Dygve | 134/107 |
| 2004/0261820 | A1* | 12/2004 | Monsrud et al. | 134/10 |
| 2005/0241683 | A1* | 11/2005 | Jeong | 134/58 D |
| 2008/0210279 | A1* | 9/2008 | Hildenbrand | 134/56 D |
| 2008/0264455 | A1* | 10/2008 | Brewer et al. | 134/95.2 |

FOREIGN PATENT DOCUMENTS

| | | | |
|---|---|---|---|
| DE | 7205233 | U | 5/1972 |
| DE | 10159651 | A1 | 6/2003 |
| DE | 102007041305 | A1 | 3/2009 |

* cited by examiner

*Primary Examiner* — David Cormier
(74) *Attorney, Agent, or Firm* — James E. Howard; Andre Pallapies

(57) ABSTRACT

A dishwasher includes a washing container having a washing chamber, an expansion housing with a condensing surface, and an expansion line with a first end connected to the washing chamber and a second end in the expansion housing.

14 Claims, 3 Drawing Sheets

Detail Z

DISHWASHER

BACKGROUND OF THE INVENTION

The invention relates to a dishwasher.

Dishwashers are usually fitted with what is called an expansion system, by means of which an expansion in volume of air or water vapor enclosed in the washing chamber occurring as a result of an increase in temperature can be accommodated.

In a generic dishwasher, the expansion system has an expansion line. The expansion line can, in order to equalize pressure in the washing container, conduct water vapor and/or air out of the washing chamber.

SUMMARY OF THE INVENTION

An object of the invention is to provide a dishwasher in which the expansion line is positioned in a simple design so as to prevent vapor discharge in the direction of electrically operated appliance components and/or in the direction of adjacent furniture walls.

An object is achieved in a dishwasher, having at least one washing container and an expansion line, which with its first end establishes a connection to the washing chamber of the washing container and through which during a pressure-equalization process water vapor and/or air can be conveyed out of the washing chamber.

The expansion line with its second line end is guided into an expansion housing having at least one condensing surface. The vapor which may possibly escape from the expansion line can therefore condense on the internal sides of the expansion housing which act as condensing surfaces. In this way, a vapor discharge from the expansion housing can largely be prevented. In addition, the line end of the expansion line can be fixed in a simple design in the expansion housing.

It is preferably provided that the condensing surface is arranged opposite the second line end. Vapor emerging out of the second line end is thereby brought directly into contact with the condensing surface so as to condense there.

It is furthermore preferably provided that the condensing surface is embodied as a draining incline. This ensures that the condensate collects in the bottom region of the expansion housing.

It is preferably provided in this respect that the draining incline is embodied so as to run substantially vertically. Here, substantially vertically is understood also to mean a deviation of up to 30°, in particular 45°, from the vertical. To form this draining incline, the expansion housing can in cross section be embodied substantially trapezoidally, for example as a uniform trapezoid.

Finally, it is preferably provided that the expansion housing and the condensing surface are embodied such that they are of a uniform material and/or of one piece, in particular in a plastic injection-molding process.

To reduce parts complexity, the expansion housing, of a uniform material and/or of one piece, in particular in a plastic injection-molding process, can be integrated into the washing container, in particular into the washing-container base wall. In this way the underside of the washing-container base wall can be used directly as a boundary surface for the expansion housing.

The expansion housing is preferably closed to the appliance interior. A vapor discharge in the direction of the electronic components which are arranged below the washing-container base wall is prevented by this means. In deviation herefrom, the expansion housing can also be arranged in other positions on the outside of the washing container.

It is preferable if the expansion housing is designed so as to be open on a side facing away from the electrically operated appliance components. In this connection, it is preferable if the expansion housing is designed so as to be open to the appliance exterior, so that vapor which may possibly escape or vapor condensate which may drain on a side facing away from the appliance components can discharge from the expansion housing.

To speed up dishwasher assembly, easy positioning and fastening of the expansion line to the expansion housing are important. For ease of fastening, the expansion housing can have an assembly opening into which the line end of the expansion line can be inserted. The insertion depth of the expansion line can vary in a direction of insertion, as long as the outlet opening of the expansion line remains inside the expansion housing. This enables, in terms of assembly, easy fastening of the expansion line to the expansion housing with large tolerance compensation.

BRIEF DESCRIPTION OF THE DRAWINGS

An exemplary embodiment of the invention is shown below with the aid of the attached drawings, in which.

DETAILED DESCRIPTION OF EXEMPLARY EMBODIMENTS OF THE PRESENT INVENTION

Figure 1:
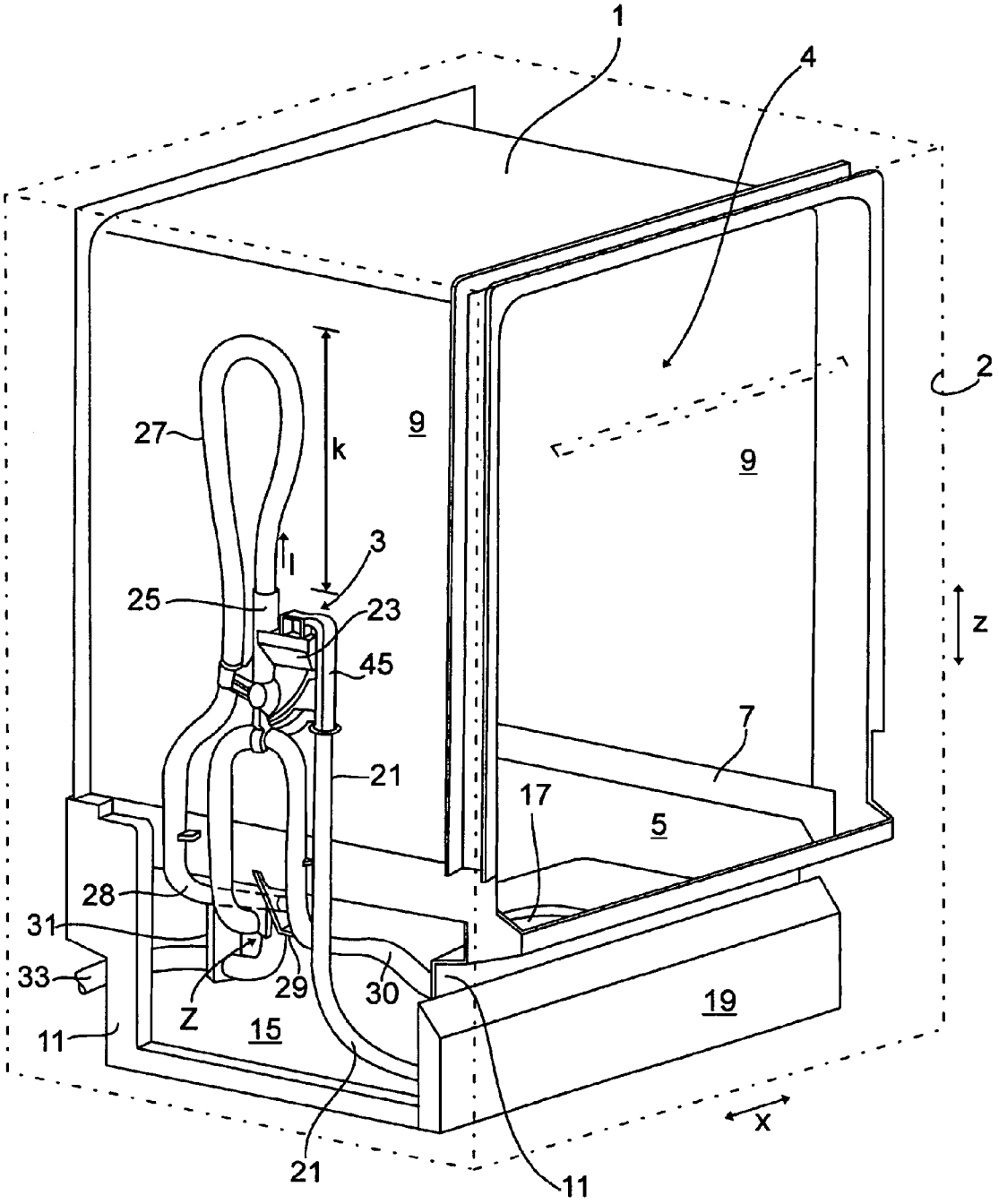
FIG. 1 shows a dishwasher in a coarsely schematic representation.

FIG. 1 shows a dishwasher in a coarsely schematic perspective representation. The housing walls and the appliance door 2 of the dishwasher are for reasons of clarity indicated by dot-dashed lines. To facilitate understanding of the invention, only a washing container 1 with externally arranged water inlet or a water inlet device 3 and with associated fluid lines is shown, while a representation of the further appliance components, such as for example circulating pump, drain pump or control electronics components, is omitted.

The washing-container base wall 5 is embodied in the present exemplary embodiment as a plastic injection-molded part. The base wall 5 is equipped with laterally raised edge sides 7, on which the side walls 9 and the back wall of the washing container 1 sit. The side walls 9 and the back wall are manufactured out of stainless steel sheet.

The base wall 5 bordering the washing chamber 4 of the washing container 1 is supported at the base by means of lateral supporting profiles 11. Below the base wall 5, an assembly chamber 15 is formed in which appliance components such as for example a pump sump 17 or the circulating and drain pumps (not shown) are arranged.

The assembly chamber 15 is covered on the front side by a front panel 19 provided below the appliance door 2. Immediately behind the front panel 19 there is located on the appliance side a water inlet valve (not shown). Connected to the water inlet valve is in a known manner a feed hose (also not shown) leading to the water supply. A feed line 21, which leads to a housing 23 of the water inlet device 3, is additionally connected to the water inlet valve. The housing 23 of the water inlet device 3 has a connecting piece 25, to which an expansion line or an expansion hose 27 is connected, which is guided in a loop-like rising duct firstly upward along the washing-container side wall 9 and then downward in an opposing direction into the assembly chamber 15. Also shown is an outlet hose 30 coming from the pump sump 17 or the drain pump, which outlet hose is also guided upward along the side wall 9 in the shape of a loop. The outlet hose 30 is held in its upwardly pointing bow section by means of a holding bracket integrated onto the housing 23. Its hose end is held on the back of the appliance in a further holding element 31 and flow-connected to an external drain line 33.

The housing 23 of the water inlet device 3 opens via a washing-container opening (not shown) into the washing chamber 4 of the washing container 1. When filling the washing container 1 with fresh water, the water inlet valve (not shown) on the front side is opened, as a result of which fresh water can flow from the water supply network via the feed line 21 and the water inlet device 3 into the washing chamber 4.

Besides this water inlet function, an equalization of pressure is effected via the water inlet device 3, whereby heated air or heated water vapor in the washing chamber 4 is pushed as a result of an expansion in volume through the housing 23 into the expansion line 27. The expansion line 27 is guided with its open line end 28 into an expansion housing 29, which is arranged in the assembly chamber 15 below the washing container 1.

As a result of the heating of the washing liquid during a wash cycle, the air or the water vapor enclosed in the washing chamber 4 expands. To equalize pressure, the expanding air or water vapor can flow through the washing-container opening into the water inlet device 3. The water vapor then rises as shown in FIG. 1 in the direction of an arrow I upward into the expansion line 27. The part of the expansion hose 27 leading vertically upward from the connecting piece 25 serves as a condensing section k, in which the vapor condenses and is carried back as condensed water into the water inlet device 3.

In the event that the appliance door 2 is opened for a short time during a wash cycle, what is called an expansion shock can occur, in which the air entering into the washing chamber 4 from outside is suddenly heated and in this way an excessively large quantity of vapor or air is conveyed into the expansion hose 27. In this case, the quantity of vapor along the condensing section k cannot condense fully. Rather, some of the water vapor can pass through the condensing section k and be conveyed in a defined manner via the expansion hose 27 into the expansion housing 29 arranged in the assembly chamber 15. In the case of an expansion shock, condensation of vapor on side furniture walls within an installation recess of the dishwasher is prevented. Rather, a defined discharge of vapor occurs within the region of the assembly chamber 15.

Figure 2:
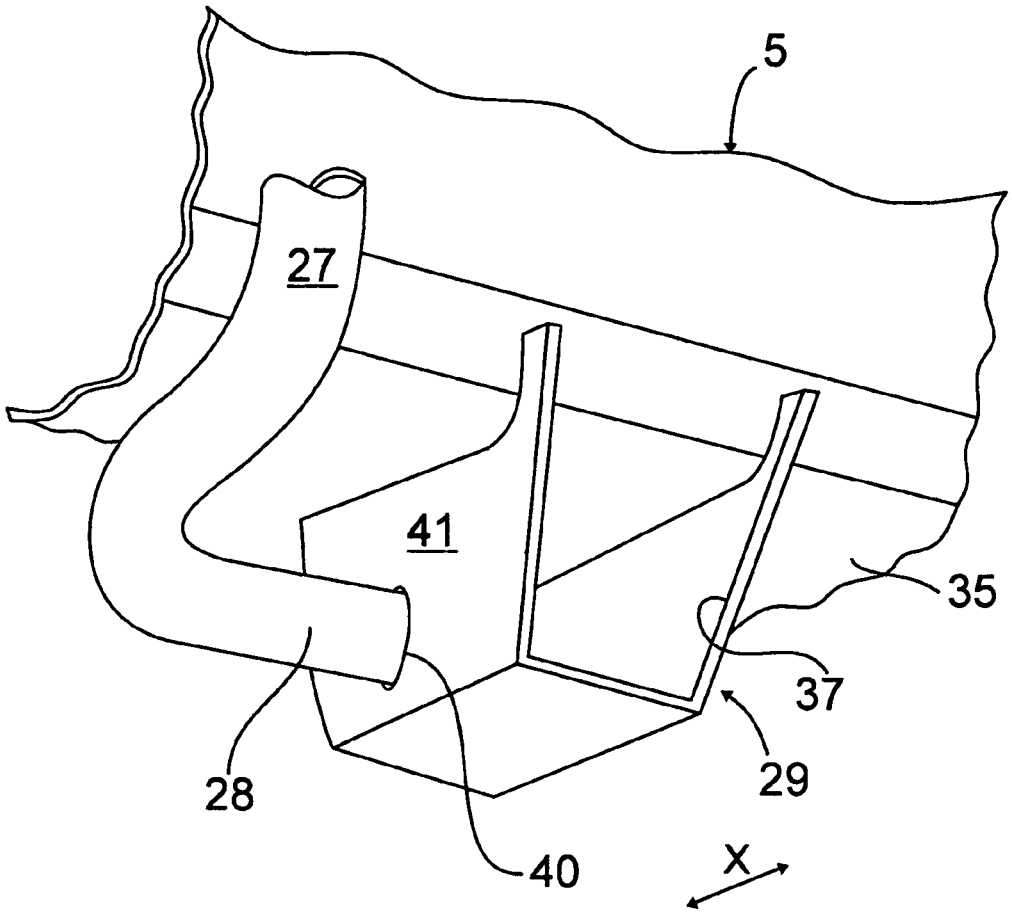
FIG. 2 shows in an enlarged detailed view the detail Z from FIG. 1.
Figure 3:
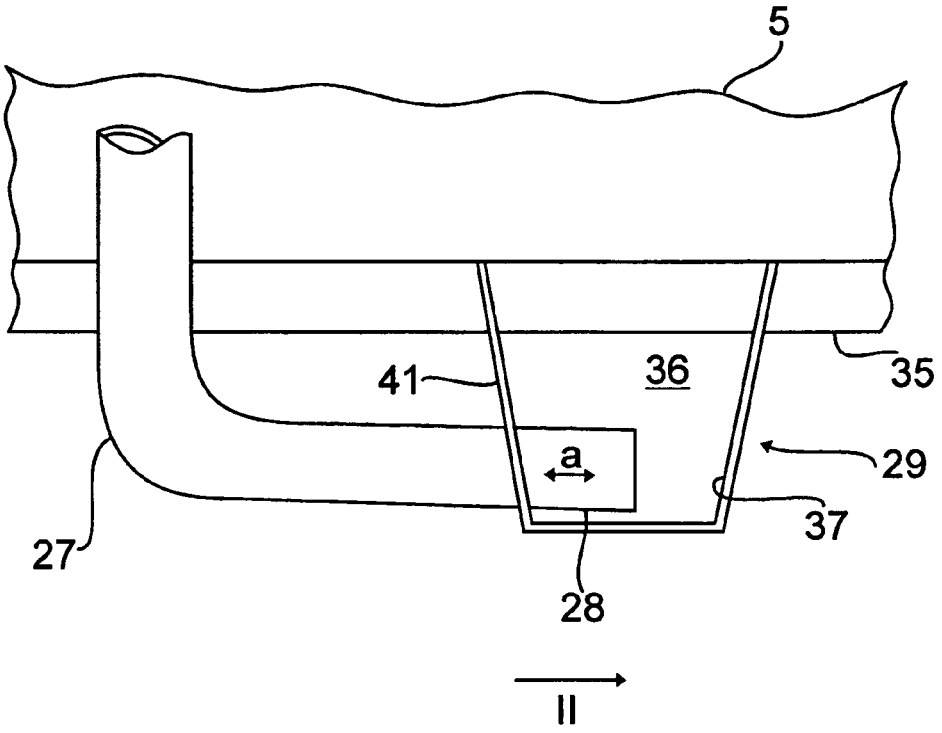
FIG. 3 shows the expansion housing in a side view.

FIGS. 2 and 3 show the expansion housing 29 in a detailed view. According to these, the expansion housing 29 is molded in a plastic injection-molding process to an underside 35 of the washing-container base wall 5. The underside 35 of the washing-container base wall 5 borders the expansion housing 29 at the top.

As can further be seen from FIGS. 2 and 3, the expansion housing 29 is closed to the interior of the assembly chamber by means of a back wall 36. It also has a housing opening and a condensing surface 37 running substantially vertically, on which condensing surface the vapor emerging from the second line end 28 can condense and run down. Vapor or condensate which may possibly escape out of the housing opening of the expansion housing 29 can, due to the arrangement of the housing opening, escape at a distance from the electrically operated components inside the assembly chamber 15.

The open line end 28 of the expansion line 27 is guided, as shown in FIGS. 2 and 3, through an assembly opening 40 in a side wall 41 of the expansion housing 29. The diameter of the assembly opening 40 is designed such that the line end 39 can be guided through the assembly opening 40 with clearance and thereby in an easy-to-assemble manner. The line end 28 can be inserted with a large tolerance compensation a in the direction of insertion II into the assembly opening 40 of the expansion housing 29, provided that it is ensured that the outlet opening of the expansion line 27 projects into the inside of the expansion housing 29.

The invention claimed is:

1. A dishwasher, comprising:

a housing;

a washing container within the housing having a washing chamber formed from a plurality of interconnected walls, wherein at least one side wall defines an opening into the washing chamber;

an assembly chamber within the housing, the assembly chamber being under the washing container;

an expansion housing within the assembly chamber, the expansion housing being a box-like structure having a floor, three side walls upstanding from the floor and one side open to atmosphere, with a condensing surface on one side wall of the box-like structure, a single expansion housing inlet in another side wall of the box-like structure and an expansion housing outlet defined by the open side of the box-like structure; and an elongate expansion conduit with an expansion conduit inlet in fluid communication with the opening into the washing chamber and an expansion conduit outlet operatively connected to the expansion housing inlet within the assembly chamber, the expansion conduit being open to atmosphere only at the expansion conduit inlet and at the expansion housing outlet.

2. The dishwasher of claim 1, wherein the condensing surface opposes the expansion conduit outlet.

3. The dishwasher of claim 1, wherein the condensing surface comprises a draining incline.

4. The dishwasher of claim 3, wherein the draining incline is substantially vertical.

5. The dishwasher of claim 1, wherein the expansion housing and the condensing surface form a plastic injection-molded part.

6. The dishwasher of claim 1, wherein a base wall of the washing container and the expansion housing form a plastic injection-molded part.

7. The dishwasher of claim 1, wherein the expansion housing receives the expansion conduit outlet and is otherwise closed to a dishwasher interior.

8. The dishwasher of claim 1, wherein the expansion housing is open to a dishwasher exterior.

9. The dishwasher of claim 1, wherein the expansion housing defines an assembly opening into which the expansion conduit outlet is inserted.

10. The dishwasher of claim 1, wherein internal sides of the expansion housing form the condensing surface for vapor condensation.

11. The dishwasher of claim 1, wherein the expansion conduit extends generally vertically along the at least one side wall of the wash container and curves under the washing container for engagement with the expansion housing.

12. The dishwasher of claim 11, wherein the expansion housing includes an expansion housing side wall having an opening formed therein and the expansion conduit extends into the opening formed in the expansion housing side wall and the condensation surface is generally vertical and in opposition to the expansion conduit outlet.

13. The dishwasher of claim 1, wherein the dishwasher includes a arrangement for guiding the expansion conduit upwardly from a position adjacent the opening to the washing container, through a curved region and downwardly from the curved region to the expansion housing.

14. A dishwasher, comprising:

a housing;

a washing container within the housing having a washing chamber formed from a plurality of interconnected walls, wherein at least one side wall defines an opening into the washing chamber;

an assembly chamber within the housing, the assembly chamber being under the washing container;

an expansion housing within the assembly chamber, the expansion housing being formed with a condensing surface, a single expansion housing inlet and a single expansion housing outlet open to atmosphere; and an elongate expansion conduit extending generally vertically along the at least one side wall of the wash container with an expansion conduit inlet in fluid communication with the opening into the washing chamber and an expansion conduit outlet operatively connected to the expansion housing inlet within the assembly chamber, the expansion conduit being open to atmosphere only at the expansion conduit inlet and at the expansion housing outlet, wherein the expansion conduit curves under the washing container for engagement with the expansion housing and wherein the expansion housing includes an expansion housing side wall having an opening formed therein and the expansion conduit extends into the opening formed in the expansion housing side wall and the condensation surface is generally vertical and in opposition to the expansion conduit outlet.

* * * * *

UNITED STATES PATENT AND TRADEMARK OFFICE

CERTIFICATE OF CORRECTION

PATENT NO. : 9,107,562 B2
APPLICATION NO. : 12/381883
DATED : August 18, 2015
INVENTOR(S) : Werner Haltmayer et al.

It is certified that error appears in the above-identified patent and that said Letters Patent is hereby corrected as shown below:

On The Title Page, Item (73) Assignee should read

--(73) Assignee: BSH Hausgeraete GmbH, Munich (DE)--

Signed and Sealed this
Twenty-ninth Day of March, 2016

Michelle K. Lee

Michelle K. Lee
*Director of the United States Patent and Trademark Office*